United States Patent [19]

Pons

[11] 4,438,622

[45] Mar. 27, 1984

[54] APPARATUS FOR AUTOMATIC CREELING IN RING SPINNING FRAMES

[76] Inventor: Roberto E. Pons, Ronda General Mitre, 105,4°,1a, Barcelona 6, Spain

[21] Appl. No.: 355,251

[22] Filed: Mar. 5, 1982

[30] Foreign Application Priority Data

Mar. 10, 1981 [ES] Spain ..... 500.247

[51] Int. Cl.[3] ..... D01H 9/18; D01H 15/00

[52] U.S. Cl. ..... 57/261; 57/90; 57/266; 57/269; 57/281

[58] Field of Search ..... 57/90, 261–263, 57/266, 267, 269, 276, 281

[56] References Cited

U.S. PATENT DOCUMENTS

| | | | |
|---|---|---|---|
| 3,721,081 | 3/1973 | Ishida | 57/281 |
| 3,828,682 | 8/1974 | Klein | 57/281 X |
| 3,935,821 | 2/1976 | Maier et al. | 57/281 X |
| 4,030,281 | 6/1977 | Schopper et al. | 57/261 X |
| 4,165,601 | 8/1979 | Igel | 57/261 X |
| 4,176,514 | 12/1979 | Stalder | 57/261 |

FOREIGN PATENT DOCUMENTS

| | | |
|---|---|---|
| 974524 | 11/1964 | United Kingdom . |
| 975424 | 11/1964 | United Kingdom . |
| 1179632 | 1/1970 | United Kingdom . |

*Primary Examiner*—John Petrakes
*Attorney, Agent, or Firm*—Young & Thompson

[57] ABSTRACT

Apparatus for automatic creeling in ring spinning frames, constituted by a frame capable of patrolling along a ring spinning frame, in inspection service to detect missing rovings, and is provided with an upwardly movable operative body and a supply of full roving packages to cover the needs and comprises also in combination:

(a) structure for detecting missing roving;
(b) creeling structure for releasing the exhausted bobbin or roving with broken strand;
(c) structure for retaining the end of a new roving;
(d) structure for gripping the new roving end and passing it around the spinning frame roving rods and delivering it to the drafting system; and
(e) structure for replacing the roving sliver loading device.

6 Claims, 29 Drawing Figures

FIG. 7A
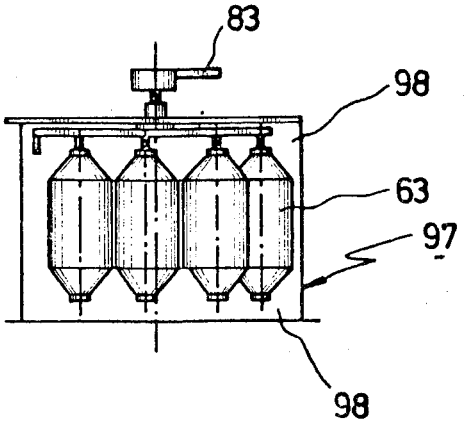
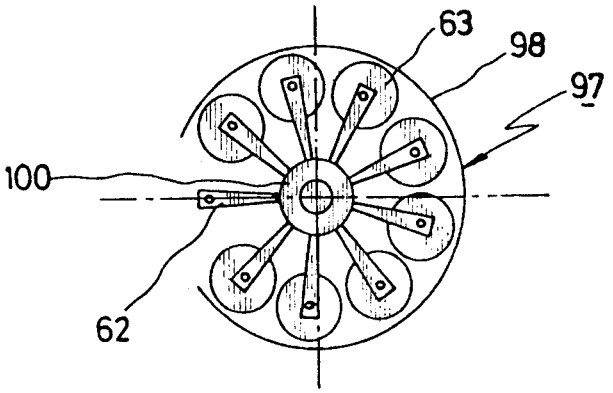
FIG. 7B
FIG. 7C
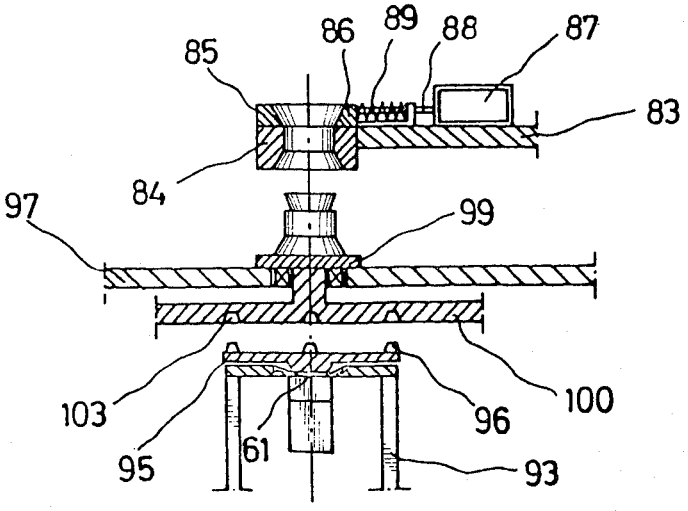

APPARATUS FOR AUTOMATIC CREELING IN RING SPINNING FRAMES

This invention relates to an apparatus for automatic creeling in ring spinning frames and operates in cases of both exhaustion of the roving package and broken strand situations, replacing the package, thereafter feeding the roving from the latter for delivery to the drafting system.

The apparatus provides for rapid intervention to ensure feeding of the frame at all times, by automatic means, avoiding the use of costly expert manual labor. Finally, both in case of broken strand or exhaustion of the roving package, the piecing up may be done by hand or with other automated mechanical devices.

The apparatus according to the invention is constituted by a frame capable of patrolling along the ring spinning frame, for an inspection service to detect missing rovings, and is provided with an upwardly movable operative body and a loading device with a full roving package supply to cover the needs and comprising also in combination the following elements:

(a) means for detecting missing feed rovings for each of the frame spindles and for stopping the apparatus in the pertinent place;

(b) creeling means for releasing the exhausted bobbin or bobbin with broken strand and for replacing it with a full bobbin;

(c) means for retaining the end of the roving from the freshly creeled package;

(d) means for gripping of said roving end and passing it round the spinning frame roving rods, for insertion thereof in the drafting system trumpet;

(e) means for replacing the roving package loading device when the full roving package supply has been exhausted.

The invention is also characterized in that the missing roving detection means consist of a light emitting source and a light receiving element, determining the stoppage of the apparatus in the place of detection.

The invention is also characterized in that the creeling means consist of a device mounted on the moving body and which is provided with a support movable on horizontal ways on which there pivots, under mechanical control, a tiltable platform carrying a truncated cone guide member, a fixed semicircular jaw member and a movable semicircular jaw member actuated by an electromagnet so as to press the bobbin bases between both members, whereby to release a bobbin with broken or exhausted roving, the moving body is raised and moves the moving support until the bobbin is reached, the latter being seized, said moving body thereafter being moved downwards for ejection, the moving body being raised again to grip a full bobbin from the loading device and hang it in place of the other.

The invention is likewise characterized in that the full roving package end retaining means comprises vertical arms associated with a loading device driven from the frame and provided with nippers which hold said end on being closed.

A further feature of the invention is that the means for gripping the full roving package end and feeding it to the drafting system around the roving rods, is comprised by at least one set of moving nippers driven by motors, capable of taking the end of the roving from the nipper of the loading device, capable also of giving up this end from one to the other or vice versa for passing round the roving rods and capable finally of inserting the said roving end in the corresponding guide trumpet of the drafting system in any position of the stroke thereof.

A further feature of the invention is that the roving package are fed by transportable loading devices and that the means for changing the loading devices consists of an arm rotatable in a horizontal plane and vertically slidable, having at one end a clamp for the removal and insertion of the loading devices.

Other objectives and features of the invention will be disclosed in detail in the following description, with reference to the accompanying illustrative drawings, in which:

FIGS. 7A and 7B are a side view and a rear view, in section, of the loading device;

FIG. 7C is a side view in section of the system of attachment of the loading device to the frame and of the loading device to the conveyor arm.

Figure 1:
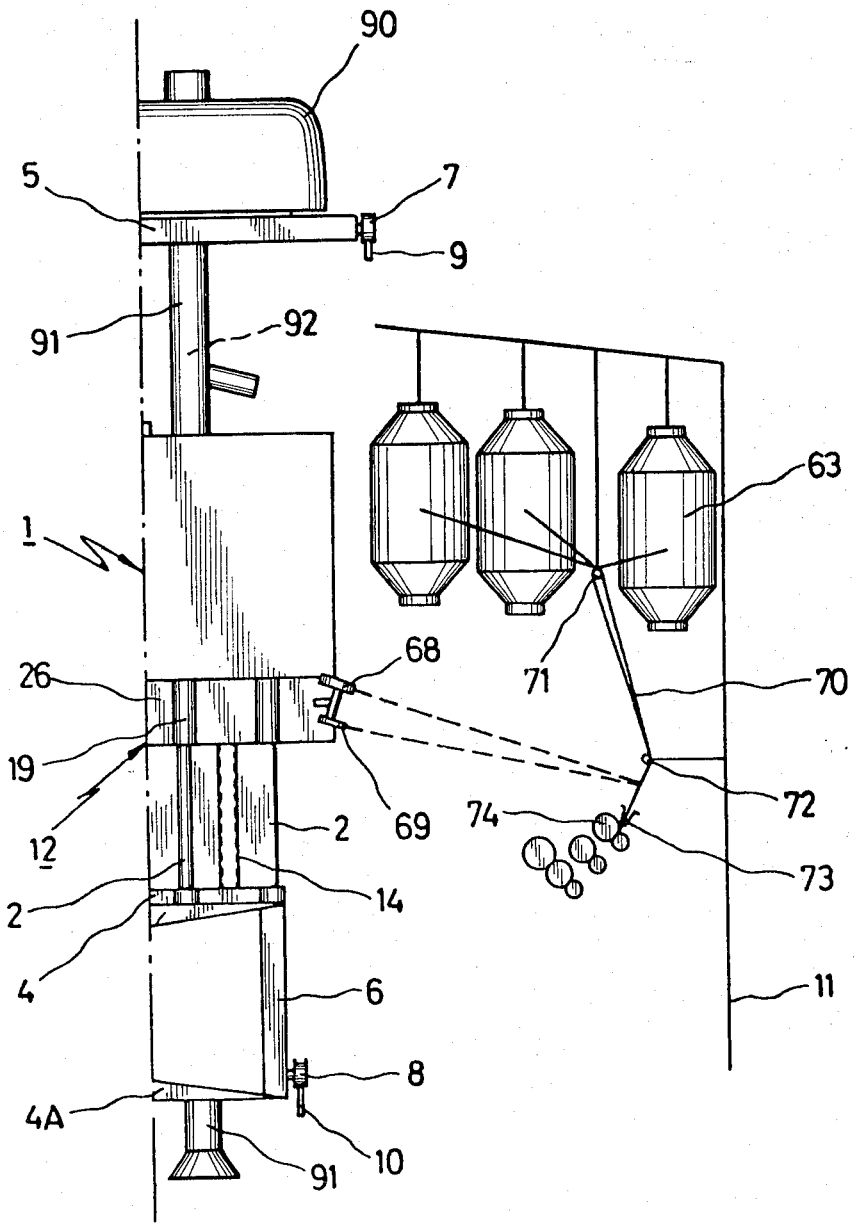
FIG. 1 is a side elevational view of an apparatus according to the invention, in front of a spinning frame.
Figure 2:
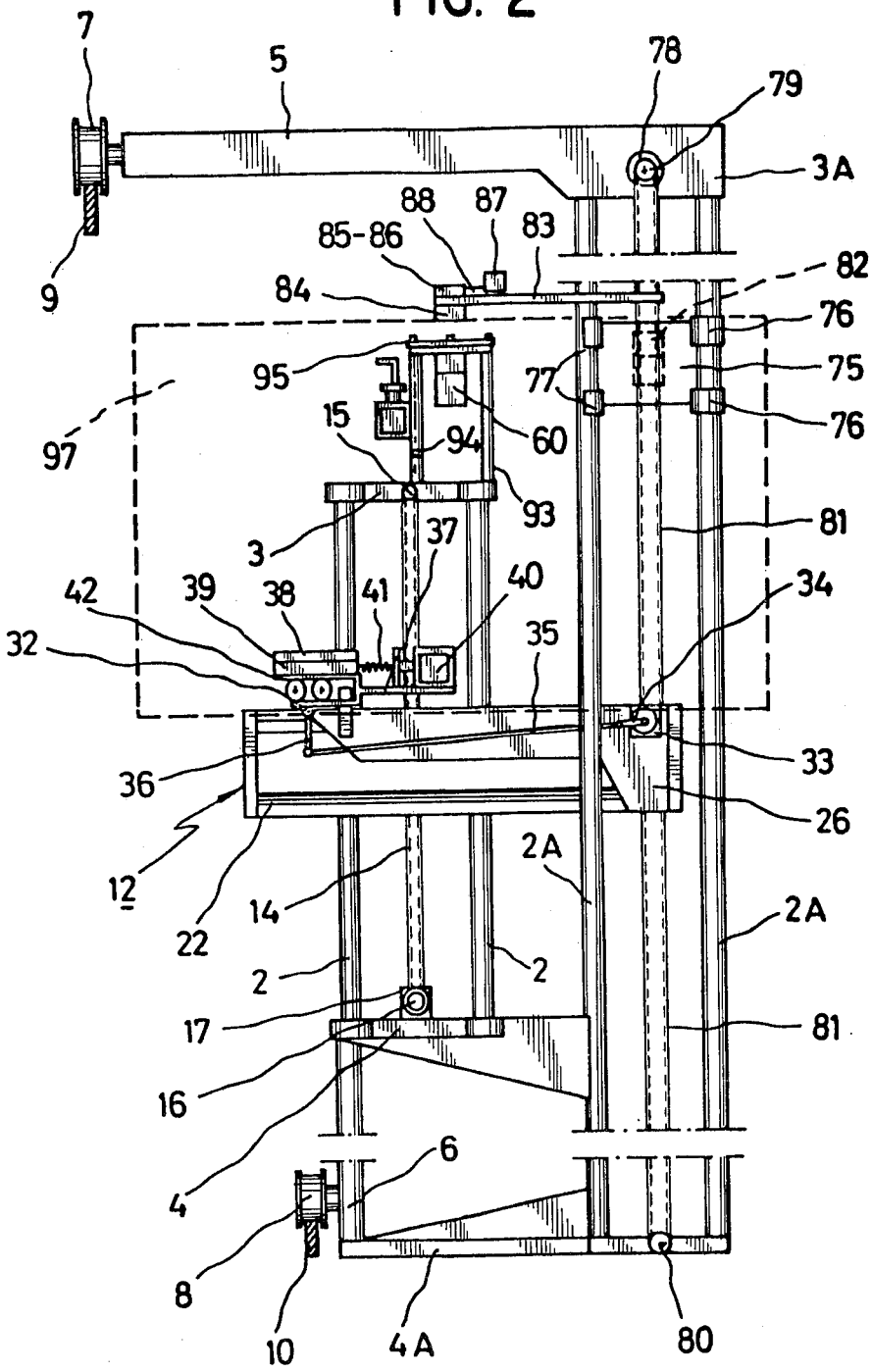
FIG. 2 is a side view of the apparatus and its moving body.
Figure 2A:
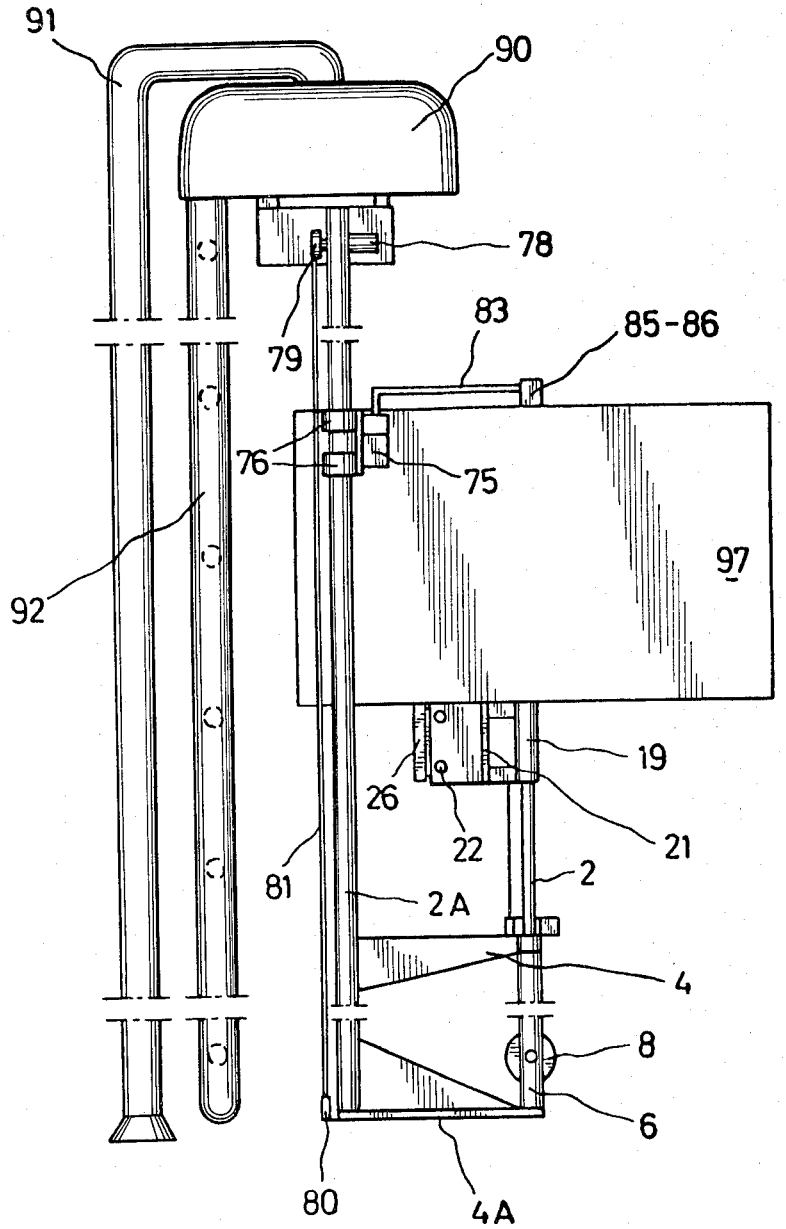
FIG. 2A is a rear view of the apparatus.
Figure 3:
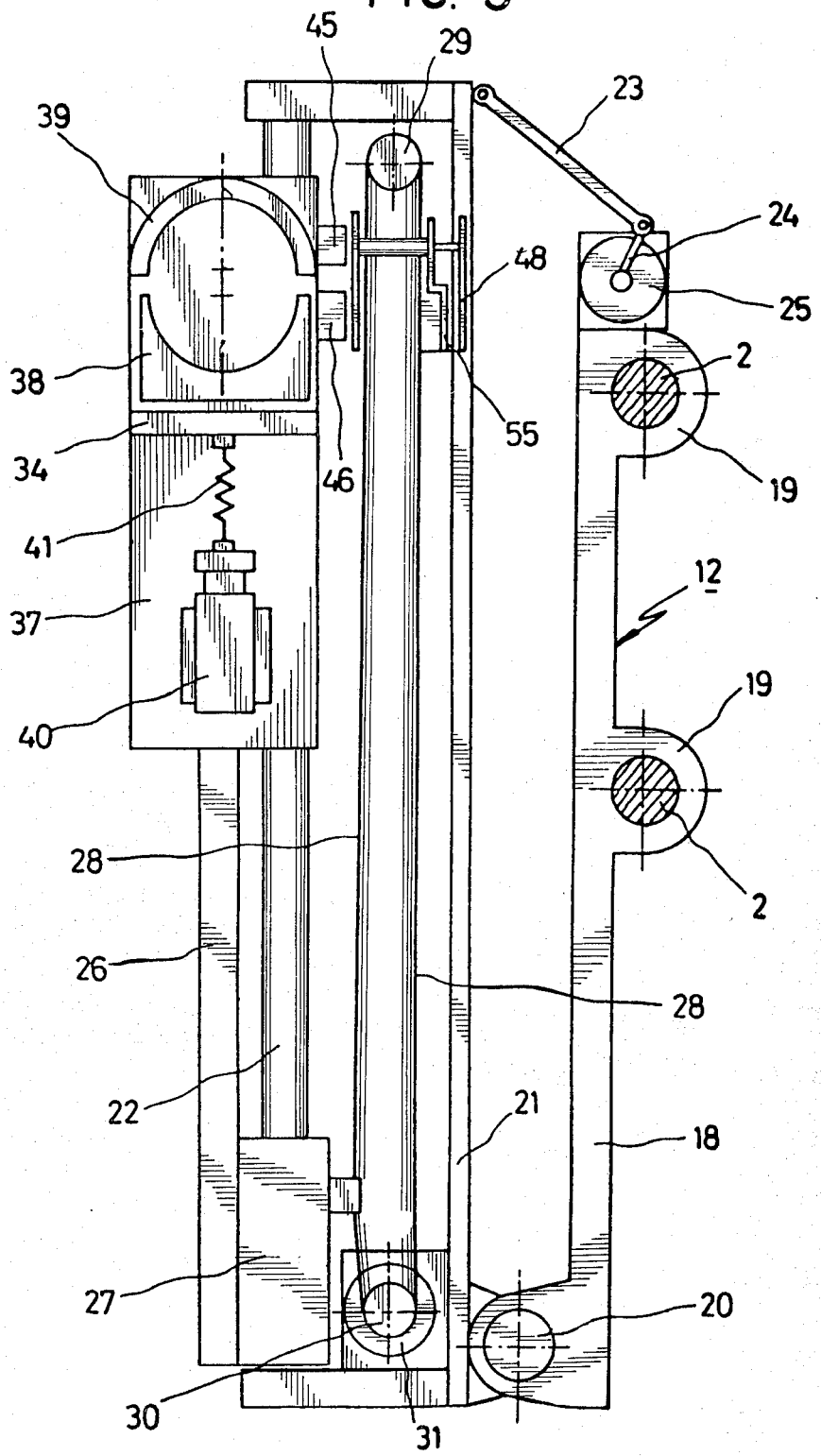
FIG. 3 is a plan view of the moving body.
Figure 4:
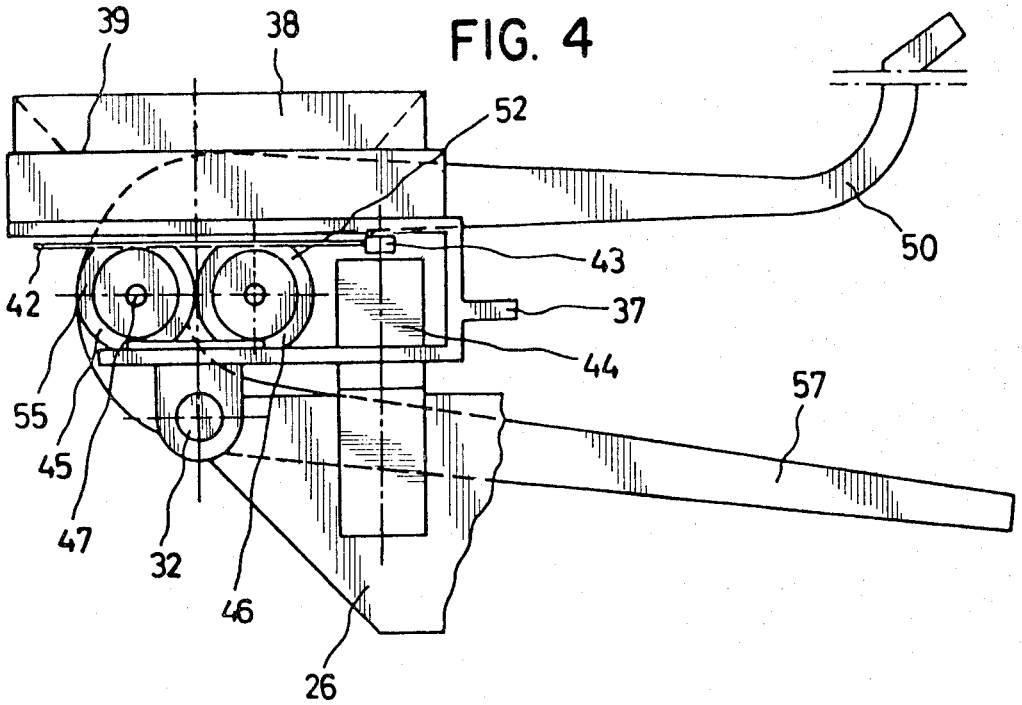
FIGS. 4 and 5 are a side and a plan view, respectively, of the moving body nipper assemblies.
Figure 5:
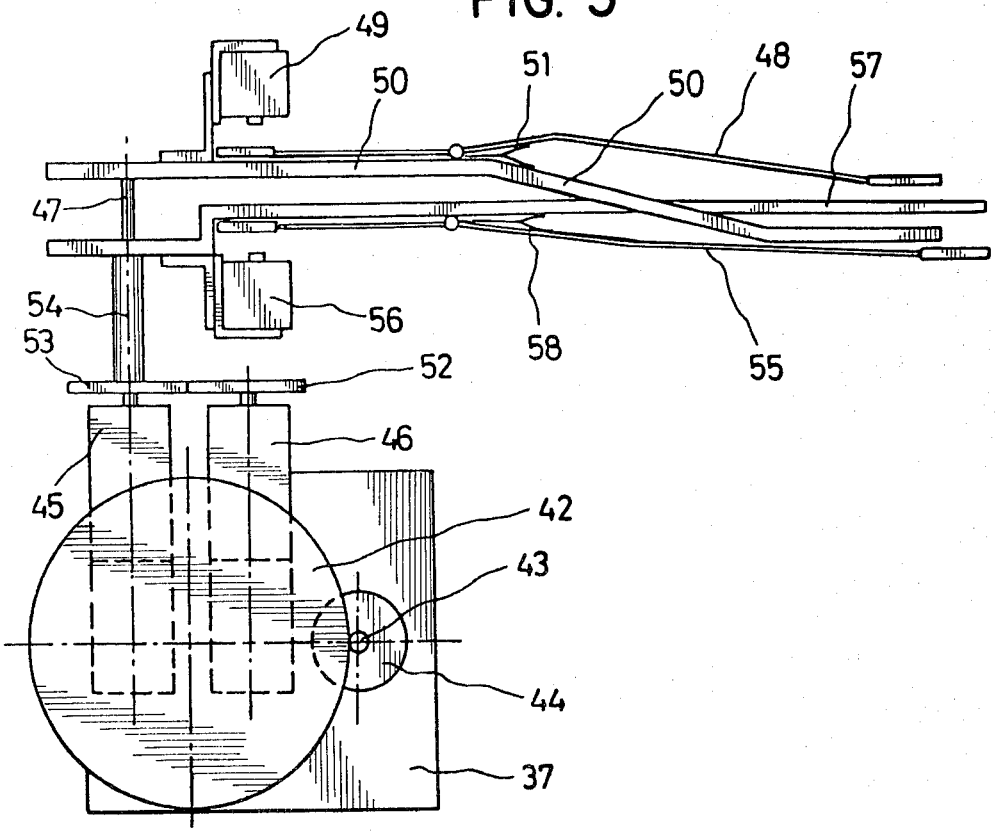

The apparatus 1 of the invention comprises a frame formed by two pairs of vertical ways 2 and 2A and two pairs of top and bottom plates 3, 3A and 4, 4A, respectively, having top and bottom arms 5 and 6, each having a wheel 7 and 8 for travelling on top and bottom rails 9 and 10, respectively, located along the spinning frame 11.

Figure 7:
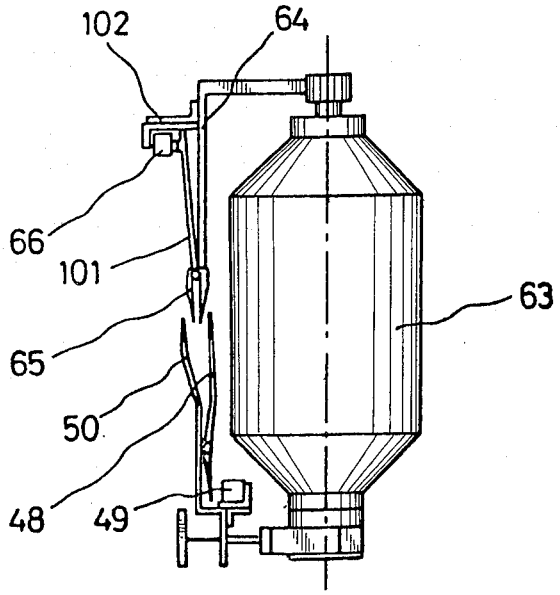

The apparatus frame supports a sliding member 75 on the ways 2A by bearings 76 and half bearings 77. The sliding member is driven by a geared motor 78 through pulleys 79 and 80 and a toothed belt 81 and supports a further geared motor 82, the shaft whereof is connected to a conveyor arm 83. At the end of arm 83 there is provided a fixed tapered member 84 and moving tapered members 85 and 86 which are connected to an electromagnet 87 by a rod 88 and a spring 89 (FIG. 7C). At the top of the frame 5 there is a suction-blower unit 90 for cleaning the spinning frame by tubes 91 and 92.

The frame of the apparatus 1 supports a vertically movable body 12, driven by a toothed belt 14 which extends between an upper pulley 15 and a lower pulley 16 connected to a geared motor 17. The movable body 12 is provided with a frame 18 with bearings 19 for sliding along the vertical ways 2 and which is connected by a shaft 20 to a support 21 provided with horizontal ways 22 and by a connecting rod 23 and crank 24 assembly driven by a geared motor 25.

The support 21 carries a frame 26 guided by bearings 27 and driven by a belt 28 extending around pulleys 29 and 30, driven by a geared motor 31. The frame 26 is provided with a shaft 32 driven by a motor 33 through a connecting rod 34, crank 35 and connecting rod 36. A platform 37 rotates with shaft 32 and carried coplanar semicircular jaw members, one of which is fixed, 38, and the other movable 39, the latter being driven by an electromagnet 40 provided with a coupling spring 41 which operates when the attraction of the electromagnet ceases.

At the bottom of the platform 37 there is a rotary disc 42 provided with teeth meshing with a gear 43 connected to a geared motor 44. The disc 42 is mounted with two motors 45 and 46, the first of which is provided on the shaft 47 thereof with the fixed jaw of a nipper 50 carrying the moving jaw 48 actuated by the electromagnet 49, there being a reopening spring 51. The motor 46 is provided on the shaft thereof with a gear 52 which meshes with a gear 53 connected to a hollow shaft 54 concentric with said shaft 47 and which holds the fixed jaw of a nipper 57 which carries the moving jaw 55 actuated by an electromagnet 56 and provided with a reopening spring 58.

At the top of the plate 3 there is a pair of supports 93 and 94 which support a geared motor 60, the shaft 61 of which is connected to a wheel 95 having three points 96 of adjustment, to which the loading drum is to be connected. The loading drum 97 (FIGS. 7A and 7B) comprises an external covering 98 acting as frame and as guard. Said cover is fixed always in the same position on the end of arm 83 by the tapered cylindrical member 84. Moreover, the cover is provided with a wheel 100, mounted on a bearing 99, said wheel 100 carrying nine arm 62, from the ends of each of which there hangs a full roving package 63. The end of the roving of these packages is held by the nipper 65 which is supported in turn by the vertical arms 64 located at the side of each bobbin. The nipper 65 may be opened by the tiebars 101 and sections 102 actuated by the electromagnet 66 located on the frame when the pertinent bobbin is in the appropriate position. The wheel 100 holding the bobbins is provided in the lower portion thereof with three apertures 103 for engagement with the wheel 95 mounted on the frame in the correct position.

The moving body 12 of the apparatus 1 is provided with missing roving detection means consisting of a light source 68 and a light receiving element 69, which is orientated towards the roving 70 in their path around the upper and lower roving rods 71 and 72 of the spinning frame 11, before reaching the trumpet 73 of the drafting system 74.

The operation of the apparatus 1 is as follows. The apparatus performs a patrol service along the spinning frame 11 such that on detecting a missing roving, it stops in the place and sets the moving body 12 thereof in movement to locate it at the desired height, while the platform 37 is moved in a horizontal plane, all under the control of appropriately located sensors and microswitches.

Figure 8:
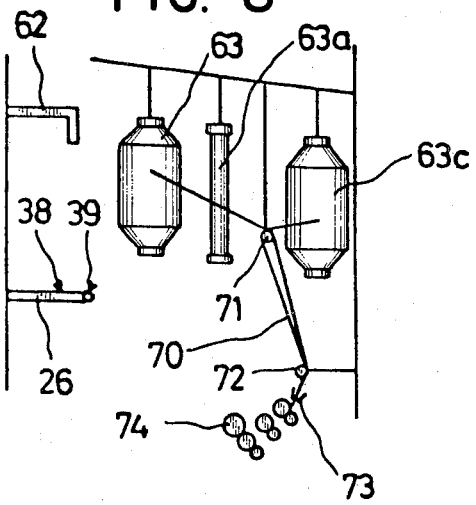
FIGS. 8 to 25 are diagrammatical views of the successive stages comprising a roving package creeling operation by the apparatus of the invention.
Figure 9:
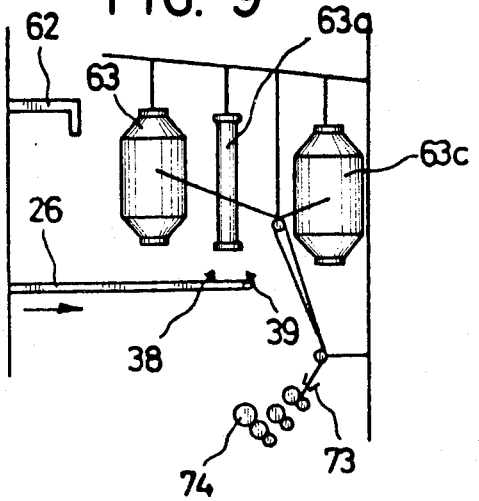
Figure 10:
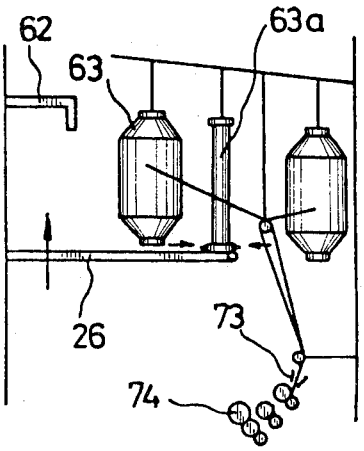
Figure 11:
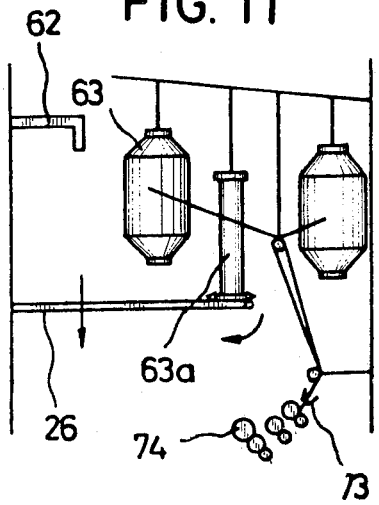
Figure 12:
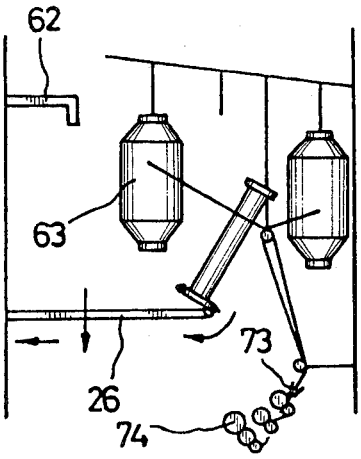

When the platform 37, starting from the position as shown in FIG. 8, has located the semicircular members 38 and 39 under a bobbin **63*a* which is empty or in broken strand situation, as illustrated in FIG. 9, the geared motor 17 drives the moving body 12 upwards until, as shown in FIG. 10, the said bobbin 63*a* is in a position to be engaged by the semicircular members 38 and 39, is raised slightly to release it, the electromagnet 40 then being activated to retain the bobbin securely. Therefore, the direction of rotation of motor 17 is reversed so that the moving body may move downwards, as shown in FIG. 11, while the motor 31 is set running and moves the frame 26 and, therefore, the bobbin 63*a*, by the belt 28, while motor 33 is set running to tilt the platform 37, tilting in turn the bobbin as shown in FIG. 12**, to be able to pass between the neighboring packages.

Figure 13:
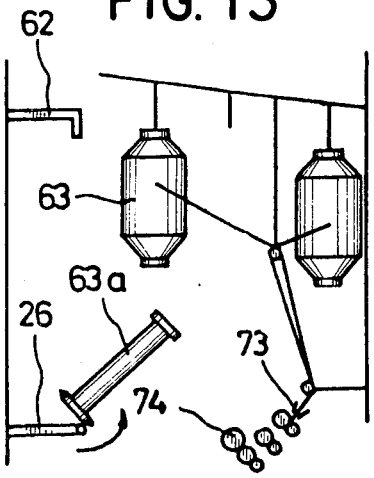
Figure 14:
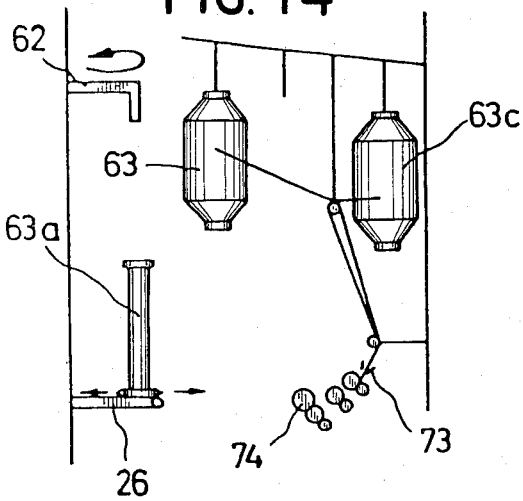

The tilting movement of the bobbin **63*a*, the backward movement thereof and the downward movement of the moving body 12 are terminated at the right time, as illustrated in FIG. 13, after which the motor 33 is restarted to return the bobbin 63*a* to the vertical position. Motor 17 is also restarted, the semicircular jaw member 39 being released by deenergization of the electromagnet 40, to locate the bobbin on a bobbin holder of loading device 62, as shown in FIG. 14**.

Figure 6:
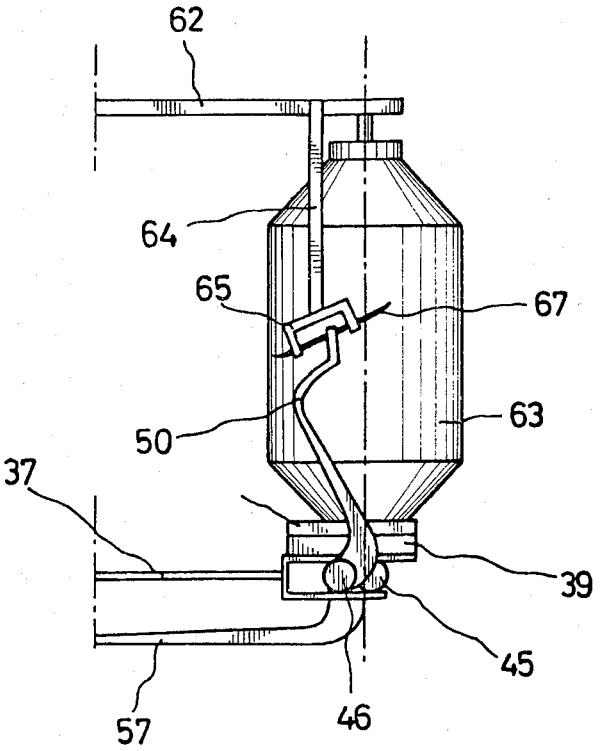
FIGS. 6 and 7 are a side and a front view, respectively, showing the relationship between the moving body nippers and the nipper adjacent the loading device.
Figure 15:
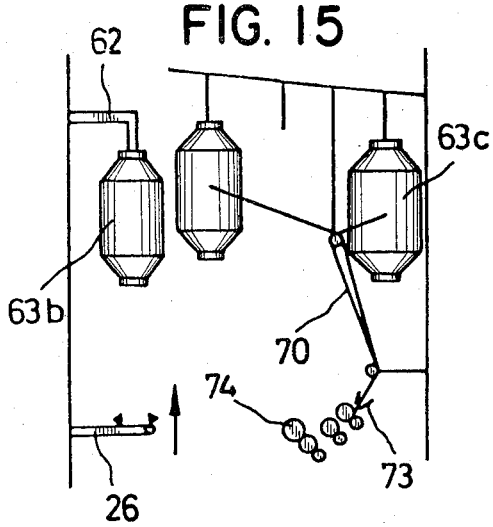
Figure 16:
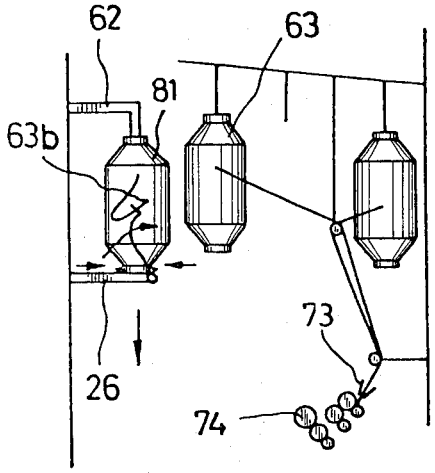
Figure 17:
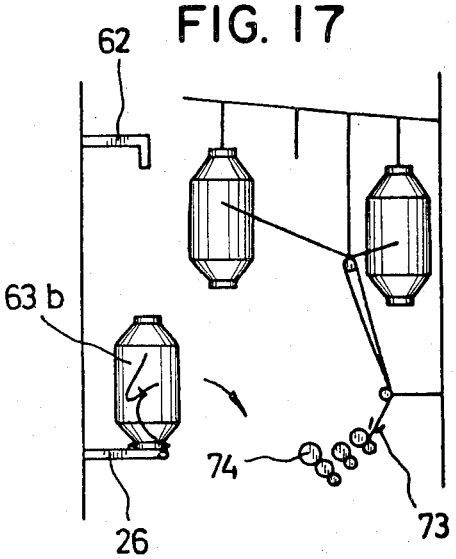
Figure 18:
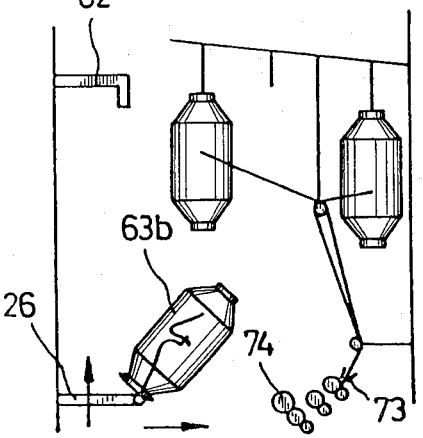

Thereafter, the moving body 12 moves downwardly and the motor 60 of the loading device is set running to locate the new package **63*b* to be creeled vertically above the semicircular jaw members 38 and 39, as illustrated in FIG. 15. Motor 17 is now set running to raise the moving body 12 so that the end 67 of the roving, as shown in FIG. 6, may be seized by the nipper 50 after the latter has rotated in the desired arc of a circle, while the said package 63*b* is held on the platform 37, the electromagnet 49 also operating to seize in turn said end 67 at the same time as nipper 65 opens to release it, as shown in FIG. 16. Thereafter the moving body 12 is lowered, as shown in FIG. 17, and the platform 37 is tilted, tilting in turn the package 63*b*, as shown in FIG. 18**.

Figure 19:
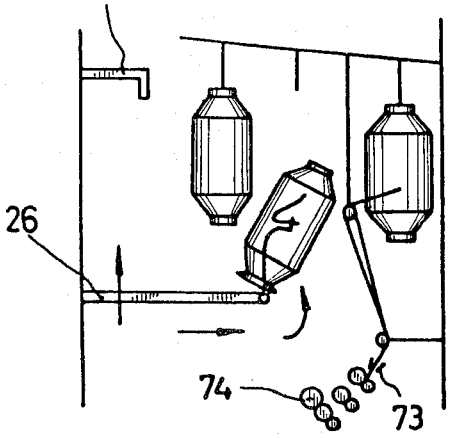
Figure 20:
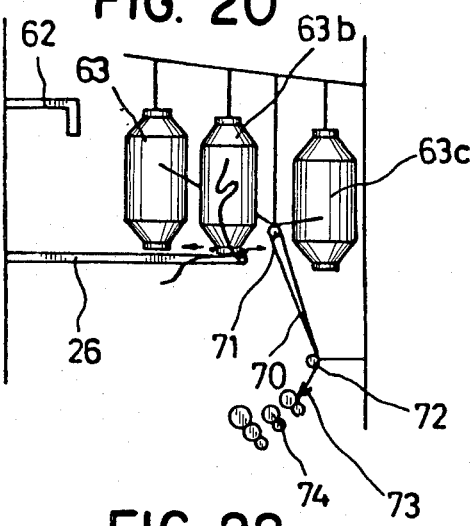

In the following stage, the moving body 12 rises and moves the package **63*b* into its operative position, as shown in FIG. 19, the horizontal movement being stopped and the vertical posture being restored. The vertical movement is now continued until said package is inserted in the roving package holder, as shown in FIG. 20**.

Figure 21:
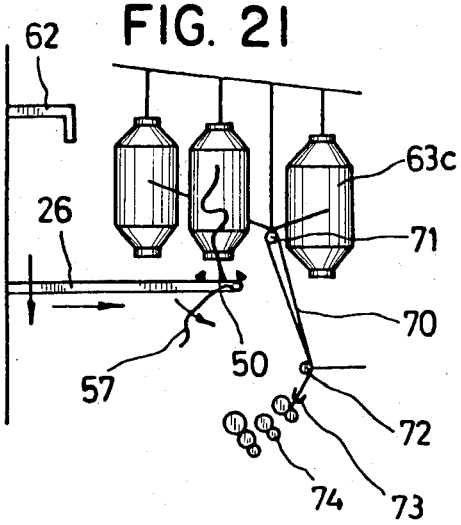
Figure 22:
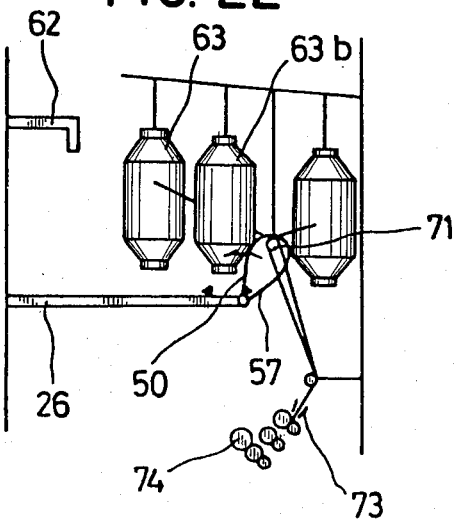
Figure 23:
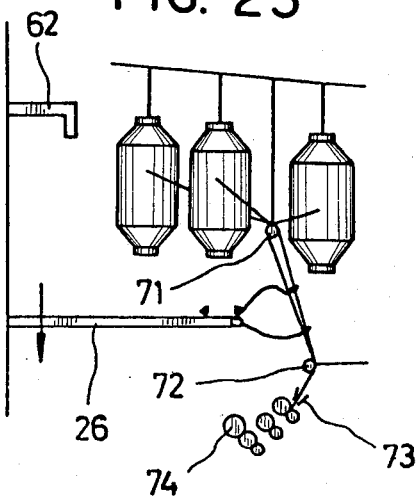
Figure 24:
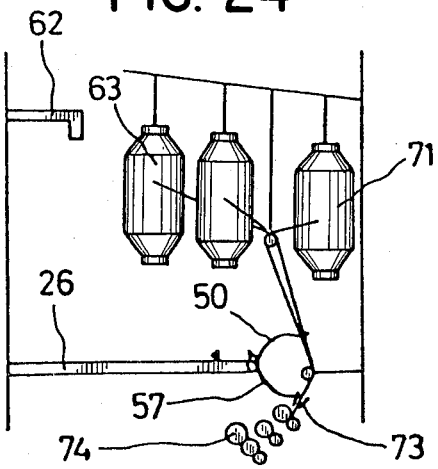

Thereafter the package **63*b* ceases to be held on the platform 37 and the moving body moves downwardly away therefrom, as shown in FIG. 21. In the following stage the nipper 57 comes into operation and, together with the nipper 50, surround the roving rod 71 in an operation for delivering the end of the roving 67 from the nipper 50 to the nipper 57, the motors 45 and 46 and electromagnets 49 and 56 being actuated at the corresponding times to reach the position illustrated in FIG. 22**.

Where there is a second roving rod 72, after the above described action, the moving body 12 moves downwardly and the nippers 50 and 57 move between the roving rods 71 and 72, as shown in FIG. 23, the nipper 57 once again delivers the end of the roving 67 to the nipper 50, this process continuing until said body is at a level close to the second roving rod 72 so that an operation similar to that performed with the bar 71 may be performed, namely, roving rod 72 is embraced by the nippers 50 and 57. In both cases, the moving body is moved thereafter, whereby the nipper 57 is caused to insert the end of the roving in a trumpet 73 located at the entry to the cylinders of the drafting system 74, as shown in FIG. 24.

Since the trumpets 73 are provided with reciprocating movement and each stopping place corresponds to two or three rovings, the nipper 57 must be adapted for lateral movement so that it may always insert the end of the roving correctly in the trumpet 73. This movement is attained by the geared motor 25, the connecting rod 23 and the crank 24 which provides for a lateral movement of the whole support 21, as shown in FIG. 23, shortly before insertion of the roving in the trumpet 73. The amount and direction of this movement will be determined by the information outputted by the spinning frame at any one time, for example, the position of a guide bar of the trumpets 73 produces a signal which is received by the geared motor 25 to locate the nipper 57 in turn in the correct position. Once the moving portion is laterally positioned, the roving is inserted in the trumpet 73 and the parts return to the original position.

Figure 25:
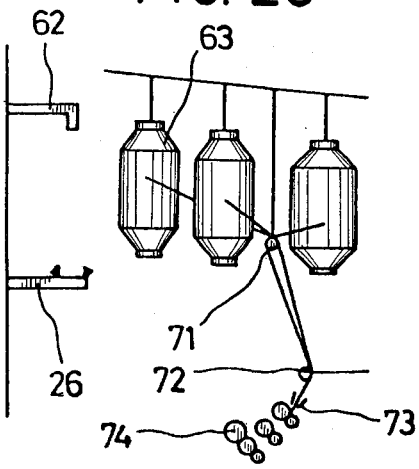

Finally, as shown in FIG. 25, the situation of the apparatus 1 returns to normal, with the raising and return of the moving body 12 thereof, namely, the frame 26 thereof carrying the operative elements, at the same time as which the fresh roving package comes into operation with the others on the frame 11, the apparatus 1 being free to continue with its patrol work along the spinning frame 11 to search for further missing roving.

It should be noted that when the roving rods 71 are located in front of the roving package, as in the case of the roving package 63*c*, once the latter is hung, the disc 42 and the nippers 50 and 57 are rotated through 180° by the geared motor 44, whereby the roving is passed around the roving rod 71 in the opposite direction following the same process as for the other roving. Once passed around the rod, the disc 42 and, consequently, the nippers 5O and 57 return to the original position after being rotated through 180° in the opposite direction by the motor 44.

Once the eight roving bobbins of the loader are empty, namely, when the drum has completed a revolution, the apparatus moves to the end of the spinning frame alongside a carriage on one side of which empty loading devices are piled and on the other side of which full loading devices are piled. At this time the motor 78 is set running to cause the sliding member 75 to rise and in turn the arm 83 and therefore the loader 97 until it is completely removed from the frame. Thereafter motor 82 is set running to cause arm 83 to rotate with the loader until the latter is located above the empty loaders. Thereafter the motor 78 is operated downwardly until the loader is piled on top of the others, at which time the electromagnet 87 is operated to release it. The assembly 75 moves upwardly again in an appropriate distance until the arm is located at a higher level than the full loading devices. At this time, the whole apparatus 1 moves sideways over a short distance to place the arm vertically over the full loading device. The assembly 75 then lowers until the arm 83 engages the loading device, at which time the electromagnet 87 is deenergized and the loading device is held tight. The assembly 75 moves upwardly to the appropriate height, the arm 83 rotates until the loading device is located vertically over the disc 95; the loading device is lowered until the discs 95 and 100 are completely engaged. The arm 83 remains in the last-named position to provide greater strength to the frame of the apparatus 1. Thereafter, the apparatus 1 returns to its patrol service along the frame, detecting missing roving, creeling and cleaning the frame.

What is claimed is:

1. Apparatus for automatic creeling in ring spinning frames having a plurality of frame spindles for holding bobbins of roving that passes from the bobbins over roving rods to a drafting system of a spinning machine, comprising a frame, means mounting said frame for movement past a plurality of bobbins of a said ring spinning frame, a body movable vertically on said movable frame, means carried by the movable frame for detecting missing roving for each of the frame spindles, means for stopping the movable frame at the location of the missing roving, means on the body for removing the bobbin on the spindle at the location of the missing roving, means on the body for creeling a full bobbin in the place of the removed bobbin, means for retaining the end of the roving from the freshly creeled bobbin, means on the body for gripping said roving end and for passing it about said roving rods to said drafting system, and means for replacing said bobbins on said movable frame.

2. Apparatus according to claim 1, characterized in that the missing roving detection means consists of a light emitting source and a light receiving element, determining the stoppage of the apparatus in the place of said missing roving.

3. Apparatus according to claim 1, characterized in that the creeling means consists of a device mounted on the moving body and provided with a support movable on horizontal ways on which there pivots, under mechanical control a tiltable platform carrying moving members which jointly exert a pressing action on the base of the pertinent bobbin, whereby to release the said bobbin when the moving body is raised and the support moves forward until the bobbin is reached, the latter being seized and removed from its support, the moving body then returning the empty bobbin to a loading device and moving again to take hold of a full reserve package and return to the place of replacement of the removed bobbin.

4. Apparatus according to claim 1, characterized in that the roving end retaining means comprises vertical arms associated with a loading device driven from the frame and provided each with nippers which hold said roving end on being closed.

5. Apparatus according to claim 4, characterized in that the means for gripping the roving end and feeding it to the drafting system for passing round the roving rods is comprised of at least one set of motor-driven moving nippers, capable of taking the end of the roving from the loading device nipper, capable also of giving up the end from one to the other and vice versa for passing round the roving rod and capable finally of inserting the said roving end in a corresponding guide trumpet of the drafting system in any position of the stroke thereof.

6. Apparatus according to claim 1, characterized in that said replacing means consists of a horizontally rotating and vertically reciprocable arm, having a grip at one end such that it may remove an empty loading device from the machine and place it on an appropriate trolley; and thereafter may engage a full loading device and deposit it on the appropriate place of the machine.

* * * * *